US007387150B2

(12) United States Patent
Liu

(10) Patent No.: US 7,387,150 B2
(45) Date of Patent: Jun. 17, 2008

(54) SHADE ROLLER CAPABLE OF BEARING HEAVY LOAD

(76) Inventor: Tai-Ping Liu, No. 18, Alley 8, Lane 3, Kuo-Chi St., Lung-Ching Hsiang (TW)

( * ) Notice: Subject to any disclaimer, the term of this patent is extended or adjusted under 35 U.S.C. 154(b) by 485 days.

(21) Appl. No.: 11/225,304

(22) Filed: Sep. 12, 2005

(65) Prior Publication Data

US 2007/0056699 A1 Mar. 15, 2007

(51) Int. Cl.

| | |
|---|---|
| ***A47G 5/02*** | (2006.01) |
| ***A47H 1/13*** | (2006.01) |
| ***E06B 9/17*** | (2006.01) |
| ***E06B 9/56*** | (2006.01) |

(52) U.S. Cl. ..... 160/321; 160/323.1

(58) Field of Classification Search ..... 160/321, 160/319, 323.1, 170, 84.04, 193; 475/162, 475/176, 177

See application file for complete search history.

(56) References Cited

U.S. PATENT DOCUMENTS

| | | | | |
|---|---|---|---|---|
| 4,372,432 | A * | 2/1983 | Waine et al. | 192/223.4 |
| 6,164,428 | A * | 12/2000 | Berman et al. | 192/223.4 |
| 6,173,825 | B1 * | 1/2001 | Liu | 192/223.4 |
| 6,739,373 | B1 * | 5/2004 | Liu et al. | 160/321 |
| 6,843,302 | B2 * | 1/2005 | Nijs | 160/321 |
| 2006/0025270 | A1 * | 2/2006 | van de Geer et al. | 475/162 |
| 2006/0084547 | A1 * | 4/2006 | Dill et al. | 475/162 |

* cited by examiner

*Primary Examiner*—Samuel S. Lin
(74) *Attorney, Agent, or Firm*—patenttm.us

(57) ABSTRACT

A shade roller has a seat, a loop hooked onto the seat, a side cover, a planet wheel engaged with the loop, a chain-retaining wheel secured in the side cover, a driving wheel engaged with the planet wheel, a beaded chain, and a fixing block engaged with the driving wheel. When the beaded chain is pulled, the planet wheel revolves around a fixing pin, and causes the driving wheel and the fixing block to revolve together, whereby a curtain can be raised or lowered.

3 Claims, 5 Drawing Sheets

SHADE ROLLER CAPABLE OF BEARING HEAVY LOAD

BACKGROUND OF THE INVENTION

1. Field of the Invention

The present invention relates to a shade roller, and particularly relates to a shade roller that can lift or lower a curtain by pulling on a beaded chain.

2. Description of the Related Art

A conventional shade roller is composed of a fixing pin, a beaded chain, a chain-retaining wheel, a planet wheel with four protrusions, a side cover having a tooth-shaped channel defined therein, and a fixing block having a groove. When they are mounted together, the beaded chain is pulled, which causes the chain-retaining wheel and the planet wheel to revolve, and in turn, the fixing block is brought to revolve, whereby the curtain is raised or lowered.

If the curtain is accidentally pulled, the protrusions secured in the grooves are pushed by the fixing block, but stopped by the chain-retaining wheel and the side cover that is engaged with the planet wheel, so that the fixing block will not continue to revolve.

However, the planet wheel is made of plastic, and heavy curtains may break off the four protrusions. The side cover, the chain-retaining wheel, and the fixing block are mounted only by the fixing pin, which can easily collapse.

Therefore, the invention provides a shade roller capable of bearing a heavy load to mitigate or obviate the aforementioned problems.

SUMMARY OF THE INVENTION

The main objective of the present invention is to provide a shade roller capable of bearing a heavy load composed of a seat, a loop, a side cover, a chain-retaining wheel, a driving wheel, a bead chain, and a fixing block revolving with the chain-retaining wheel.

The advantages of the invention are:

1. The connection is sturdier than the prior art: the shade roller has a socket defined there in, and the loop having a lug is inserted in the socket to be fixed, in addition, the loop is mounted with the side cover, the planet wheel, the chain-retaining wheel, the driving wheel and the fixing block by a fixing pin.

2. It is capable of bearing a heavy load: the above elements are all made of metal, except for a supporter, the bean chain, and the side cover; in addition, the loop is engaged with the planet wheel, which is further engaged with the driving wheel, so the whole structure is sturdy enough to bear a heavy load such as heavy curtains.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
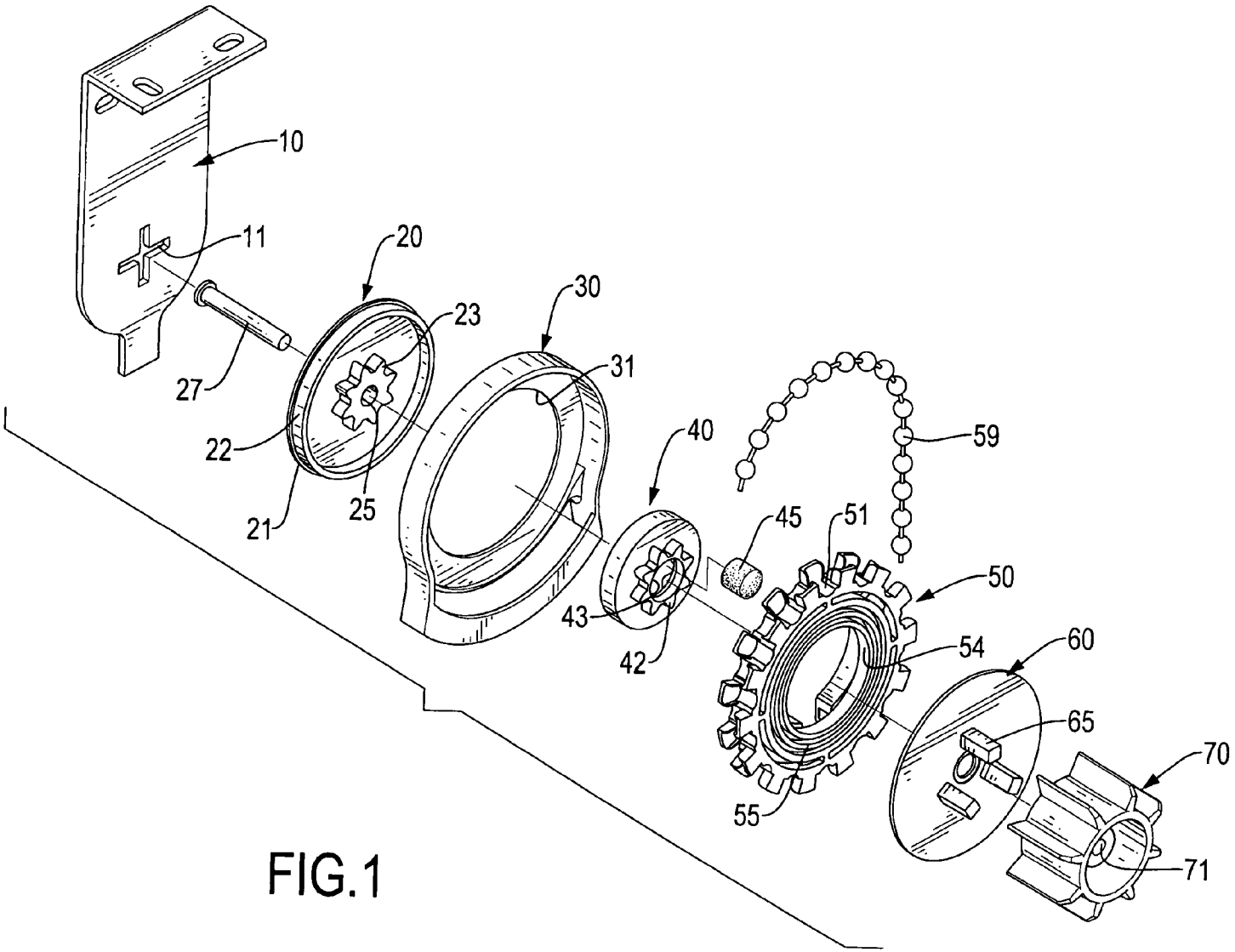
FIG. 1 is an exploded view of a shade roller in accordance with this invention.
Figure 2:
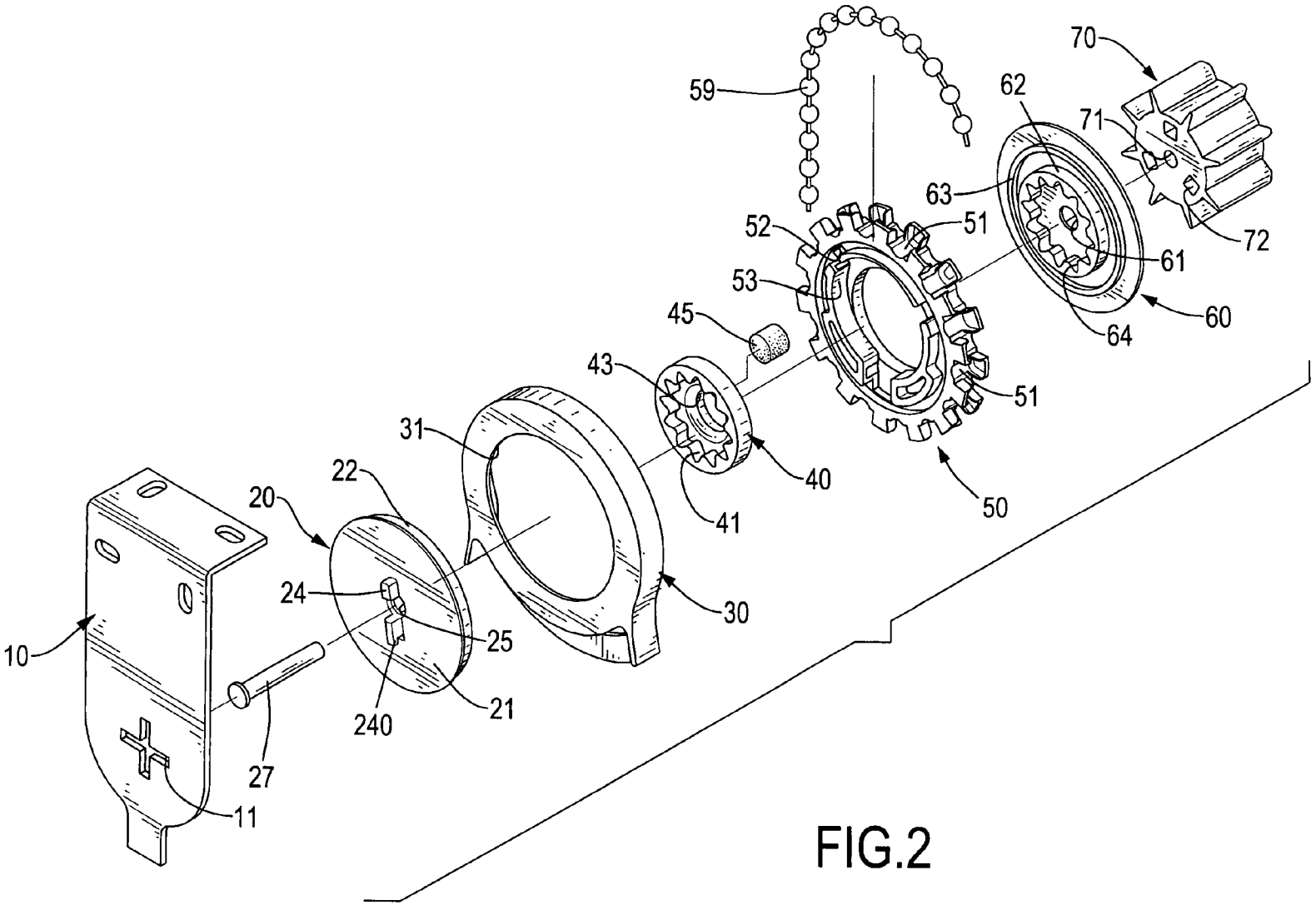
FIG. 2 is an exploded view from another angle of the shade roller in accordance with this invention.
Figure 3:
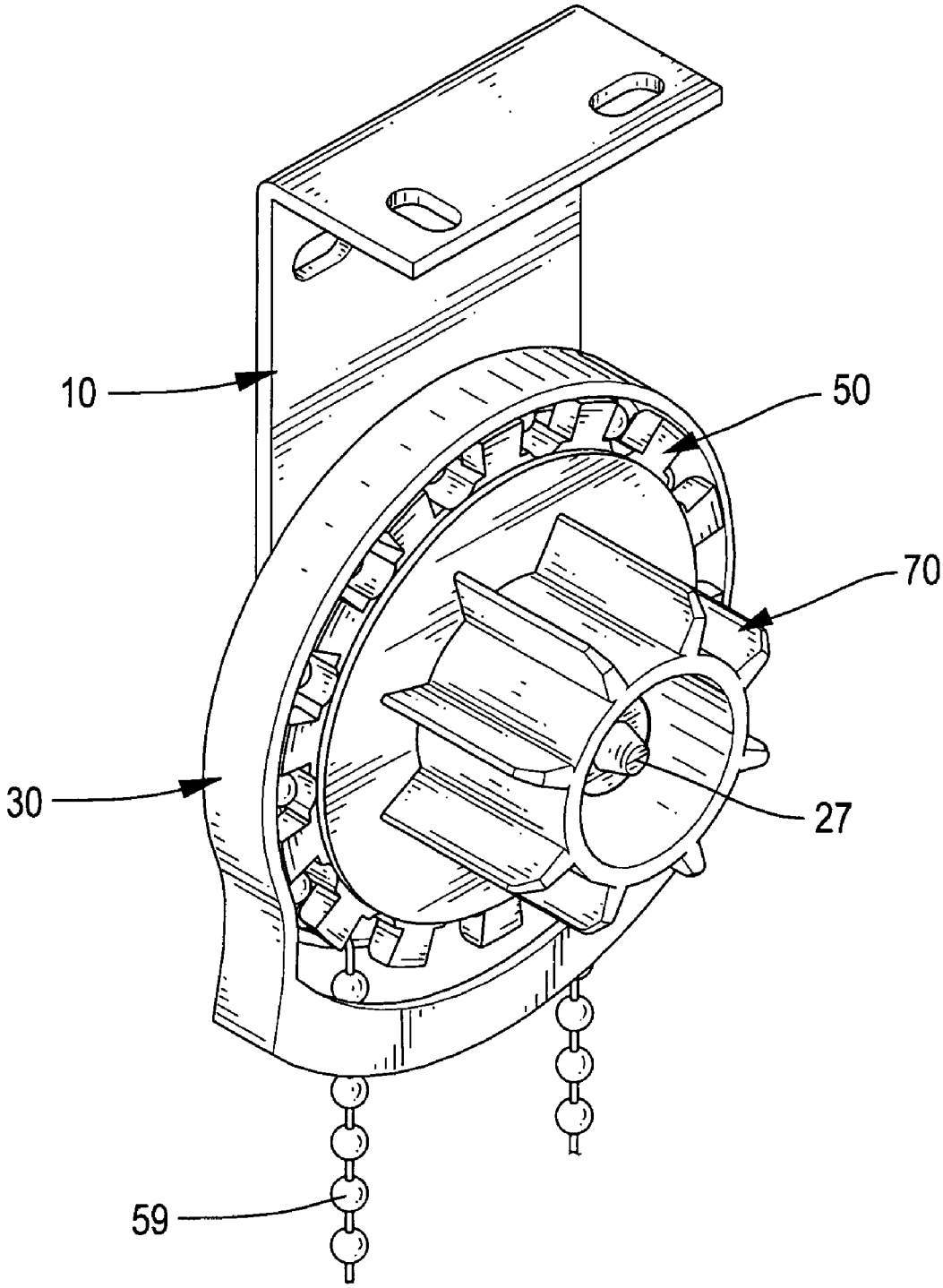
FIG. 3 is a perspective view of the shade roller in accordance with this invention.
Figure 4:
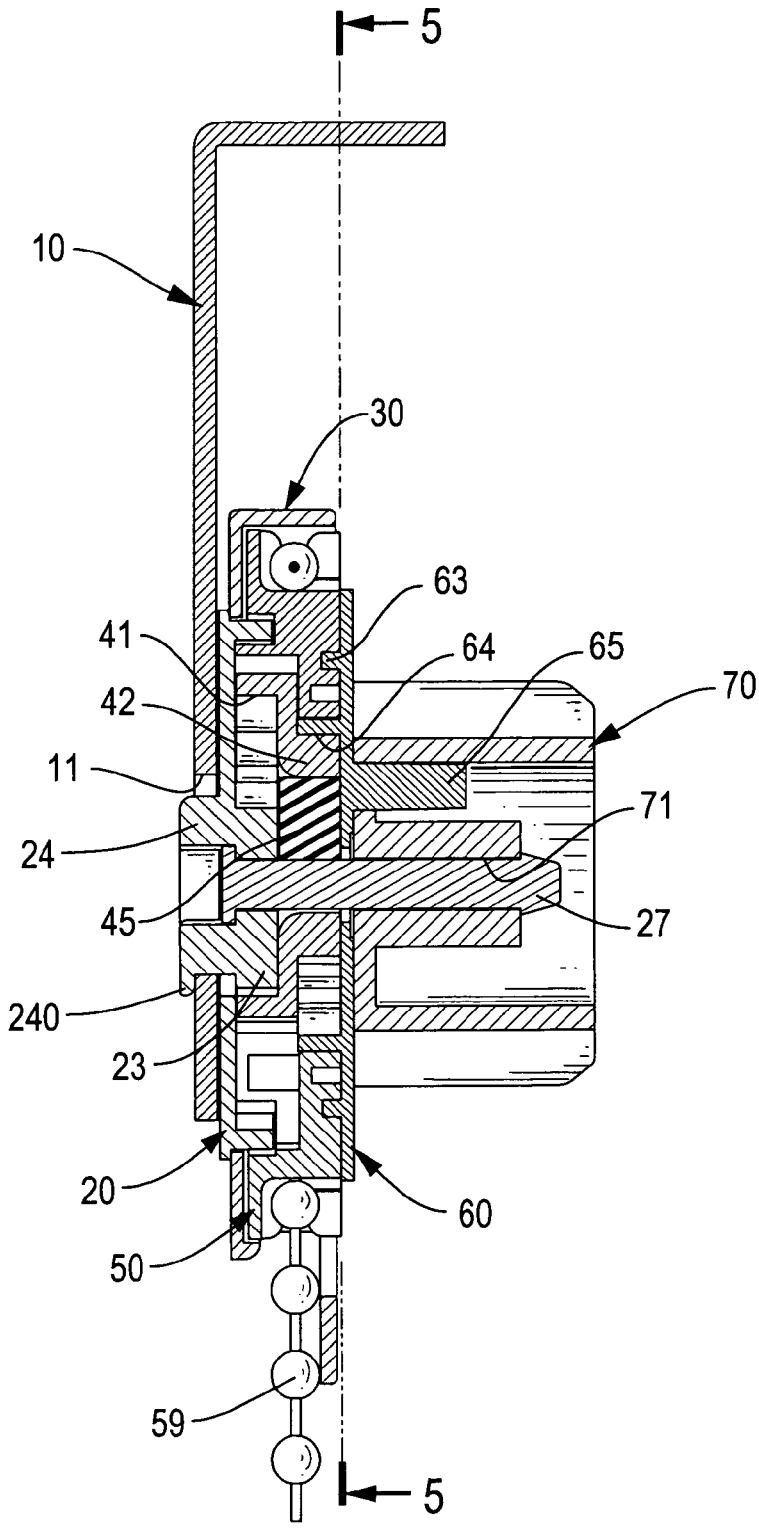
FIG. 4 is a sectional side view of the shade roller in accordance with this invention.

With reference to FIGS. 1-2, a shade roller has a seat (10) of L-shaped cross section fixed on a wall, a loop (20) hooked onto the seat (10), a side cover (30) provided round the loop (20), a planet wheel (40) engaged with the loop (20), a chain-retaining wheel (50) secured in the side cover (30), a driving wheel (60) laid over the chain retaining wheel (50) and engaged with the planet wheel (40), and a fixing block (70) engaged with the driving wheel (60) and revolving with the chain retaining wheel (50).

With reference to FIG. 1-4, the seat (10) has a socket (11) defined through.

The loop (20) comprises a plate (21), and a first flange (22) with a smaller external diameter than that of the plate (21) is formed on the plate (21) opposite to the seat (10). A first tooth member (23) is also formed on the plate (21) on the same side as the first flange (22). A lug (24) is formed on the opposite side of the plate (21) facing the seat (10), with a hook member (240) extending downwards, so that when the lug (24) is engaged in the socket (11) and pressed downward, the hook member (240) is hitched on the seat (10), whereby the loop (20) is securely hung on the seat (10). In addition, a first hole (25) is defined at the center of the plate (21), through which a fixing pin (27) is mounted through the plate (21), the planet wheel (40), the chain retaining wheel (50), the driving wheel (60), and the fixing block (70), then riveted on the fixing block (70) or mounted on the fixing block (70) by a retaining ring (not shown).

The side cover (30) has a chamber opening facing away from the seat (10) to receive the planet wheel (40) and the chain-retaining wheel (50). An opening (31) is defined on the side of the side cover (30) facing the seat (10) that sleeves onto the first flange (22) of the loop (20).

The planet wheel (40) has a first inner tooth-shaped hole (41) with an internal diameter larger than the diameter of the first tooth member (23) defined at the side facing to the seat (10) and partially engaged with the first tooth member (23). A second tooth member (42) having a same center with the first inner tooth-shaped hole (41) is formed on the side facing away from the seat (10). An aperture (43) is also defined through the planet wheel (40) to allow the fixing pin (27) through, whereby the planet wheel is able to revolve around the fixing pin (27).

The chain-retaining wheel (50) has a bead channel (51) defined around a periphery edge to secure a bead chain (59). An eccentric depression (53) is defined on the side of the chain-retaining wheel (50) facing the seat (10) and a round slot (52) is defined on the same side around the depression (53) to sleeve onto the first flange (22) of the loop (20). When the chain-retaining wheel is mounted on the loop (20), the planet wheel (40) is exactly located in the eccentric depression (53). A through slot (54) and a fixing slot (55), both having a same center with the round slot (52), are respectively defined on the side facing away from the seat (10), wherein the fixing slot (55) is around the through slot (54) and fitted to the driving wheel (60).

Figure 5:
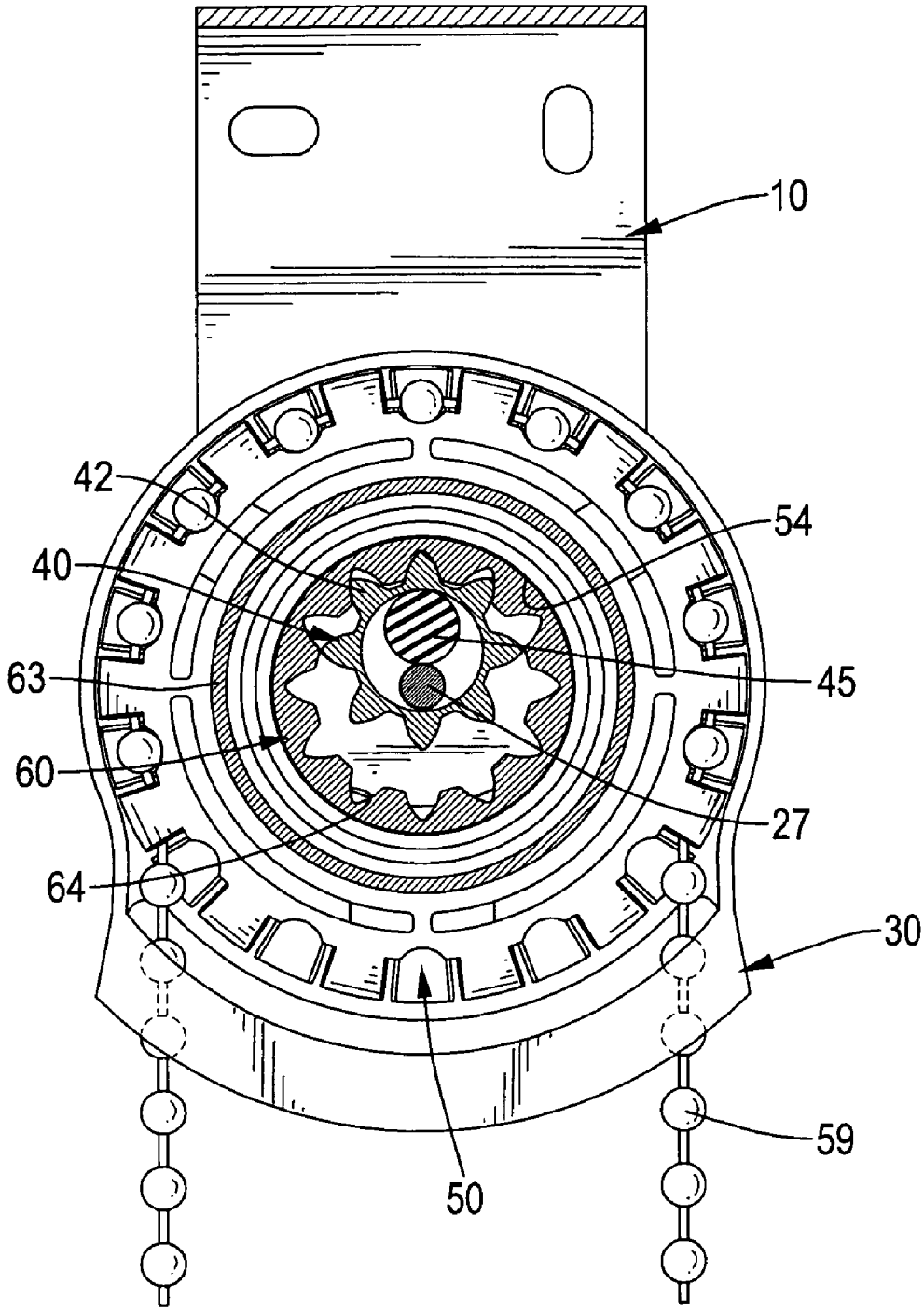
FIG. 5 is a sectional view of an end face of the shade roller along line 5-5 in FIG. 4.

The driving wheel (60) is a round plate having a second hole (61) to allow the fixing pin (27) through. A second flange (63) and a round cam (62) provided on the driving wheel (60) are respectively secured in the fixing slot (55) and the through slot (54). The round cam (62) has a second inner tooth-shaped hole (64) defined therein, which partially engages with the second tooth member (42). With reference to FIG. 5, a supporter (45) is provided between an inner wall of the aperture (43) and the fixing pin (27). The supporter (45) tightly presses the second inner tooth-shaped hole (64) to the second tooth member (42) to ensure correct engagement. Multiple protrusions (65) are axially formed on the side of the driving wheel (60) facing away from the seat (10).

The fixing block (70) has an orifice (71) to allow the fixing pin through, and multiple holes (72) are defined round the orifice (71) facing the seat (10) to receive the protrusions (65). The fixing block (70) is normally sleeved on an axial tube (not shown) that holds a curtain.

The above elements are all made of metal, with the exception of the supporter (45), bead chain (59), and the side cover (30), which enhances the strength of the shade roller. When the bead chain (59) is pulled clockwise or counter-clockwise, the eccentric depression (53) causes the second tooth member (42) to revolve around the fixing pin (27). The second tooth member (42) further causes the driving wheel (60) and the fixing block (70) to revolve, whereby the curtain is raised or lowered.

It is to be understood, however, that even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A shade roller capable of bearing a heavy load comprising a seat with a socket, a loop attached to the seat and comprised of a plate having a first flange with a smaller external diameter than that of the plate, a first tooth member and a first hole formed on a side of the plate opposite to the seat;

a side cover mounted around the loop and having a chamber and an opening that sleeves over the first flange of the loop;

a planet wheel connected to the loop, held inside the chamber in the side cover and having an aperture defined through the planet wheel, a first inner tooth-shaped hole defined a side facing the loop, and a second tooth member having a same center with the first inner tooth-shaped hole formed on a side opposite to the loop;

a chain-retaining wheel connected to the planet wheel and having a bead channel defined around a periphery edge, an eccentric depression defined on a side facing the planet wheel, a round slot defined around the eccentric depression to sleeve onto the first flange of the loop, and a through slot and a fixing slot defined on a side opposite to the eccentric depression;

a driving wheel connected to the planet wheel and the chain-retaining wheel and having a second hole, a second flange held inside the fixing slot in the chain-retaining wheel, a round cam held inside the through slot in the chain-retaining wheel and a second inner tooth-shaped hole defined in a side facing the planet wheel and partially engaging with the second tooth member in the planet wheel;

a fixing block with an orifice attached to the driving wheel;

a fixing pin extending through the plate, the side cover, the planet wheel, the chain retaining wheel, the driving wheel, and fastened on the fixing block;

a supporter provided between the inner wall of the aperture of the planet wheel and the fixing pin; and a beaded chain connected to and held in the bead channel in the chain-retaining wheel.

2. The shade roller capable of bearing a heavy load as claimed in claim 1, wherein a lug is formed on the side of the plate facing the seat with a hook member.

3. The shade roller capable of bearing a heavy load as claimed in claim 1, wherein multiple protrusions are axially formed on the a side of the driving wheel, and multiple holes are defined on a side of the fixing block to receive the protrusions.

* * * * *